US006061852A

United States Patent [19]

Bathrick et al.

[11] Patent Number: 6,061,852

[45] Date of Patent: May 16, 2000

[54] POWER INTEGRATED ARTICULATED INNER SPRING-MATTRESS

[75] Inventors: Leeland M. Bathrick, Crystal Lake; Glenn Brittain, McHenry, both of Ill.; Michael W. Chizek, Racine, Wis.

[73] Assignee: C.E.B. Enterprises, Inc., Mundelein, Ill.

[21] Appl. No.: 09/108,768

[22] Filed: Jul. 2, 1998

Related U.S. Application Data

[63] Continuation-in-part of application No. 08/308,412, Sep. 19, 1994, Pat. No. 5,568,661, which is a continuation-in-part of application No. 07/597,525, Oct. 15, 1990, Pat. No. 5,063, 623.

[51] Int. Cl.[7] ..... A47B 7/02

[52] U.S. Cl. ..... 5/618; 5/400; 5/424

[58] Field of Search ..... 5/618, 619, 617, 5/400, 401, 402, 412, 424

[56] References Cited

U.S. PATENT DOCUMENTS

| | | | |
|---|---|---|---|
| 4,463,463 | 8/1984 | Kaneko | 5/424 |
| 4,928,332 | 5/1990 | Ogden | 5/618 |

FOREIGN PATENT DOCUMENTS

| | | | |
|---|---|---|---|
| 855112 | 11/1960 | United Kingdom | 5/618 |
| 2206232 | 12/1988 | United Kingdom | 5/424 |

*Primary Examiner*—Flemming Saether
*Attorney, Agent, or Firm*—Dillis V. Allen, Esq.

[57] ABSTRACT

A power integrated articulated inner spring-mattress having a lower inner spring-like section and an upper articulated mattress section, with the lower section having all the power drive components self-contained on wooden supports surrounded by a resilient safety and appearance portion, and the upper section is easily removably mounted on the lower section wood supports.

17 Claims, 4 Drawing Sheets

POWER INTEGRATED ARTICULATED INNER SPRING-MATTRESS

RELATED APPLICATIONS

This application is a continuation-in-part of our U.S. patent application Ser. No. 308,412, filed Sep. 19, 1994 now U.S. Pat. No. 5,568,661, entitled "AN ARTICULATED BED WITH FRAME MOUNTED POWER MODULE", assigned to the assignee of the present invention, which is a continuation-in-part of our U.S. Ser. No. 597,525 filed Oct. 15, 1990, entitled "POWER MODULE FOR AN ARTICULATED BED" now U.S. Pat. No. 5,063,623.

BACKGROUND OF THE INVENTION

Articulated beds have only recently achieved significant commercial success in the residential market and previously such beds had been marketed for the most part as a hospital or nursing home product, and with such objectives have been over-designed and overly complicated and thus too costly for the residential or home market.

Over the last several decades, articulated chairs and sofas have achieved some commercial success in the residential market but only recently has such technology been adapted for the residential articulated bed marketplace.

A primary consideration in the design of articulated beds and components, therefore, in the residential market is ease of shipment because a container the size of an entire assembled articulated bed would not only be excessively large but too heavy for a single delivery person to bring into the home to install.

One attempt at solving this problem is illustrated in the Elliott U.S. Pat. No. 4,381,571 which shows an articulated mattress spring that is adapted to fit on top of and rest on a separate simple rectangular bed frame. The Elliott mattress frame includes large stationary "L" shaped side sections with cross members to provide support for axially oriented motor and screw assemblies that drive complicated four bar linkages at the four corners of the module that serve to raise and lower the head and leg sections of the mattress support. While Elliott suggests that these parts, numbering literally hundreds, may be disassembled for shipment it is realistically not practical to have the purchaser reassemble this complex device in his or her home.

A similar articulated bed is illustrated in the Neumann U.S. Pat. No. 4,120,057 and it shows a power system for an articulated mattress support and, like the Elliott design, is adapted to fit into a bed frame. The problem with the Neumann device is that it requires a large rectangular frame the size of the bed frame itself so that no size reduction is practically possible in the Neumann system.

Furthermore in the Elliott device the power module with drive motors, gearing and rocker shafts, requires that the rocker shafts be mounted in outboard bearings, i.e. bearings in the large rectangular frame described above and such outboard bearings denigrate the capability of shipping the bed in easily carried containers without requiring any significant reassembly at the purchaser's location.

Other articulated beds are illustrated in the Muir U.S. Pat. No. 1,397,773 and the Szemplack, et al. U.S. Pat. No. 3,051,965. The patent to Muir also shows a device for adjusting the articulated bed. Double motor-type systems are shown in the Taylor U.S. Pat. No. 2,500,742. Another standard articulated bed frame is illustrated in Hanning, et al. U.S. Pat. No. 3,921,230.

In our U.S. Pat. No. 5,063,623, we disclose a power module for an articulated bed assembly that fits into a completely standard bed frame. A mattress support is provided that has wooden planar panels hinged to one another with a stationary central section adapted to be bolted to the top of the standard bed frame, a pivotal head section, and pivotally interconnected thigh and foot sections. The power module has an elongated housing that supports separate electric drive motors, one for the head section and one for the thigh and foot sections. Drive gearing in the module transmits power from the motors to transversely mounted rocker shafts that have rocker arms at the ends thereof that respectively pivot the head and leg sections upwardly and downwardly with a suitable wand-type control that reversely controls the two motors.

In this patent, the power module was connected to the underside of the central stationary section of the mattress support.

In our U.S. patent application Ser. No. 308,412, we disclose an articulated bed having a modified standard bed frame that supports an independent power module replaceable without disassembly from the frame. The modified frame is of the well known horizontally collapsible angle iron-type with castered legs. The framing includes a pair of side rails each having head and foot rail portions pivotally connected thereto at their ends for packing and shipping, that interengage one another when assembled in the home.

The modification of the frame in our parent patent was the provision of inverted side rails so that the horizontally flat parts of the angle irons are at the top, and its legs are somewhat lengthened to accommodate the underslung power module. After the frame is assembled in the home, a pair of "U" shaped cross members are attached across the frame and the power module is affixed to the tops of these cross members.

This design had many of the advantages of the power module and standard bed frame disclosed in our noted patent application.

The U.S. Ser. No. 308,412 design also included a mattress support is provided that has wooden planar panels hinged to one another with a stationary central section, a pivotal head section and pivotally interconnected thigh and foot sections. The power module has an elongated housing that supports separate electric drive motors, one for the head section and one for the thigh and foot sections, and drive gearing that transmits power from the motors to transversely mounted rocker shafts that have rocker arms at the ends thereof that respectively pivot the head and leg sections upwardly and downwardly with a suitable wand switch that reversely controls the two motors.

An important aspect of that invention was the housing for the drive module provides the sole pivotal support for these two rocker shafts. As noted above these rocker shafts have previously been journaled inside frame members that require the drive module and the side frame members to be shipped as a unit from the manufacturing location to assembly location or from assembly to ultimate purchaser, because frequently the receiving party cannot technically provide the proper assembly. With the 308,412 module final set up is reduced and the power module can be shipped in a much smaller container in its completely assembled form.

Another advantage in that power module was it could be removed as a unit from the frame cross member for repair or replacement.

The U.S. Ser. No. 308,412 unitary power module, i.e. the elongated housing containing the two drive motors, the two rocker shafts, the rocker arms and interconnecting gearing, offers the manufacturer a variety of marketing options without requiring disassembly of the power module. One option is the power module manufacturer can ship the power module fully assembled to the articulated bed manufacturer, frequently skilled in wood working and to a limited extent welding, but not skilled in power drive systems. Such bed manufacturers would construct the wood planar mattress support and simply attach the power module to the cross frame member. No other interconnections would be required to complete the power module and frame assembly in operative cooperation. The articulated bed manufacturer then sells this completed assembly as a unit.

The advantage of the 308,412 invention over that shown in our parent patent, was the present design was an entire bed assembly that could be packaged for shipment to the ultimate user in three compact packages, one including the power module, one including the collapsed modified bed frame and "U" shaped cross members, and the final one containing the collapsed mattress support.

It is a primary object of the present invention to ameliorate the problems noted in the above prior art and to provide improvements over our prior designs, at least in certain aspects.

SUMMARY OF THE PRESENT INVENTION

In accordance with the present invention, a power integrated or power self-contained articulated inner spring-mattress is provided having a lower section appearing and in part functioning as a bed inner spring and having an upper articulated mattress section that appears and functions as a mattress overlying the inner spring. Toward this end, the lower section includes an "H" shaped wooden frame surrounded by a resilient peripheral platform both mounted on an enlarged "1×3" wooden base. Mounted within the "H" shaped "2×4" frame are all of the power components for the articulated mattress including two linear drives and articulated arms that drive the upper mattress section to its appropriate contours. The upper section includes a plurality of articulated metal frame members mounted beneath separate mattress platform portions that together are releasably connected to the lower section by a plurality of removable fasteners that extend through the sides of the 2×4 "H" shaped frame.

A foam mattress material is mounted on top of the mattress platforms and they are encapsulated by suitable mattress upholstery material extending beneath the mattress platform.

Because the lower section base is constructed of 1 ×3 slats, and the lower section frame is constructed of 2×4s, and the upper section platform is wooden, most of the essential elements of the present articulated inner spring mattress can be constructed and assembled by a manufacturer versed in furniture or mattress manufacture. The only components that need special fabrication are the linear actuators and the articulated arms driven thereby that can be readily purchased by the mattress manufacturer and incorporated into the wooden frame skeleton without significant technical know-how.

The lower section and upper section may be shipped or delivered to the potential customer separately and assembled together at the customer's location. The upper mattress section, according to the present invention, includes an articulated metal frame having a central section that fits within the "H" shaped 2×4 frame in the lower section and is fastened thereto by threaded fasteners that extend through the frame from its outside into nuts welded to the central section of the mattress frame. To accomplish this, the peripheral resilient perimeter of the lower section can be easily deformed to permit insertion of an appropriate tool such as a socket wrench.

An important aspect of the present invention is that the lower section has both the appearance and feel of an inner spring. Toward this end the "H" shaped 2×4 frame in the lower section is boxed in at its perimeter by a significantly large foam strip having a flat upper surface that is coplanar with the top of the "H" shaped 2×4 frame in the lower section. The advantage of this construction is that it not only gives the lower section the look and "feel" of an inner spring mattress because its sides can be manually pushed in, the resiliency of this outer perimeter strip minimizes or eliminates the possibility of a human appendage being clamped between the lower section and the upper section as the upper section mattress is lowered to its lowermost straight position on top of the flat lower section.

Another safety feature of the present invention is the provision of a bracket on the upper section mattress foot portions that maintains mattress engagement with the articulated drive in the lower section but which releases the drive from the mattress foot section as it is lowered preventing fingers or other limbs from being clamped between the mattress and the lower section.

Another important aspect of the present invention is that the linear drives mounted in the lower section are positioned perpendicular to the articulated mattress portions, namely the head portion and the leg portion, when these are in their fully raised positions providing improved support for these sections.

Other objects and advantages of the present invention will appear more clearly from the following detailed description.

DETAILED DESCRIPTION OF THE PREFERRED EMBODIMENT

Figure 3:
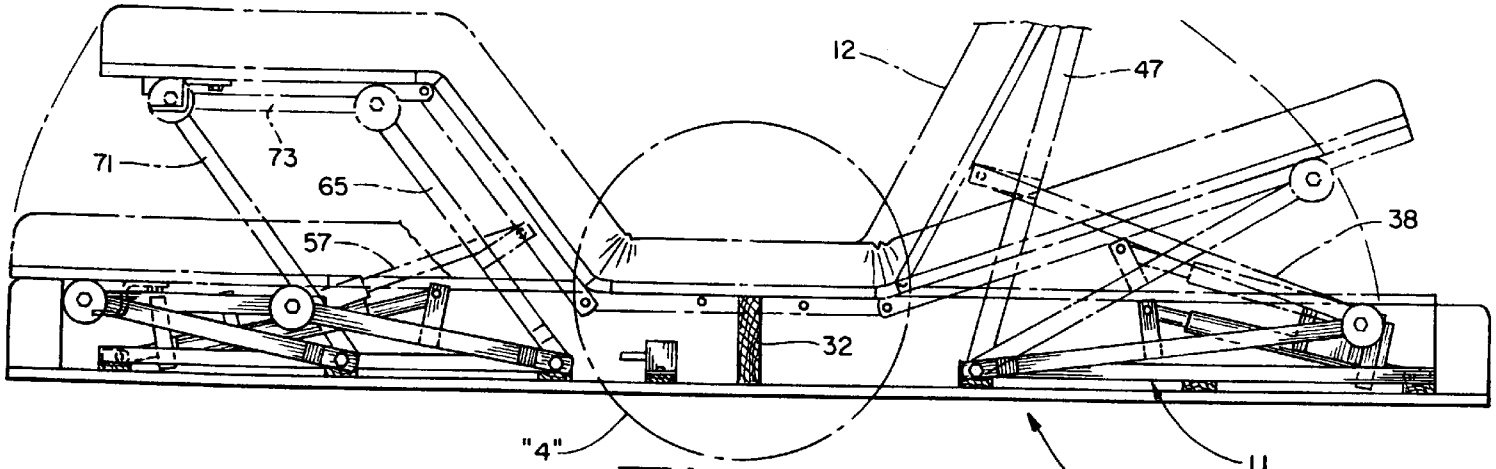
FIG. 3 is a longitudinal section of the present power integrated articulated inner spring-mattress illustrating both upper and lower sections with the upper section shown both in its fully raised position and its fully lowered position (certain portions of the upper portion have been eliminated in some intermediate views for clarity) and with the head portion shown in phantom in an intermediate position.

Referring to the drawings and particularly FIGS. 1 to 5, a power integrated articulated inner spring-mattress 10 is illustrated consisting of a lower section 11 that has the appearance and part of the functions of a standard bed inner spring which encloses and houses the operating mechanism for the present inner spring-mattress, and an articulated mattress-like upper section 12 having a central portion 14 releasably fixed to the lower section 11 and adjacent articulated portions that are raised and lowered generally as seen in FIG. 3 to various positions to accommodate the human form in various positions.

Figure 1:
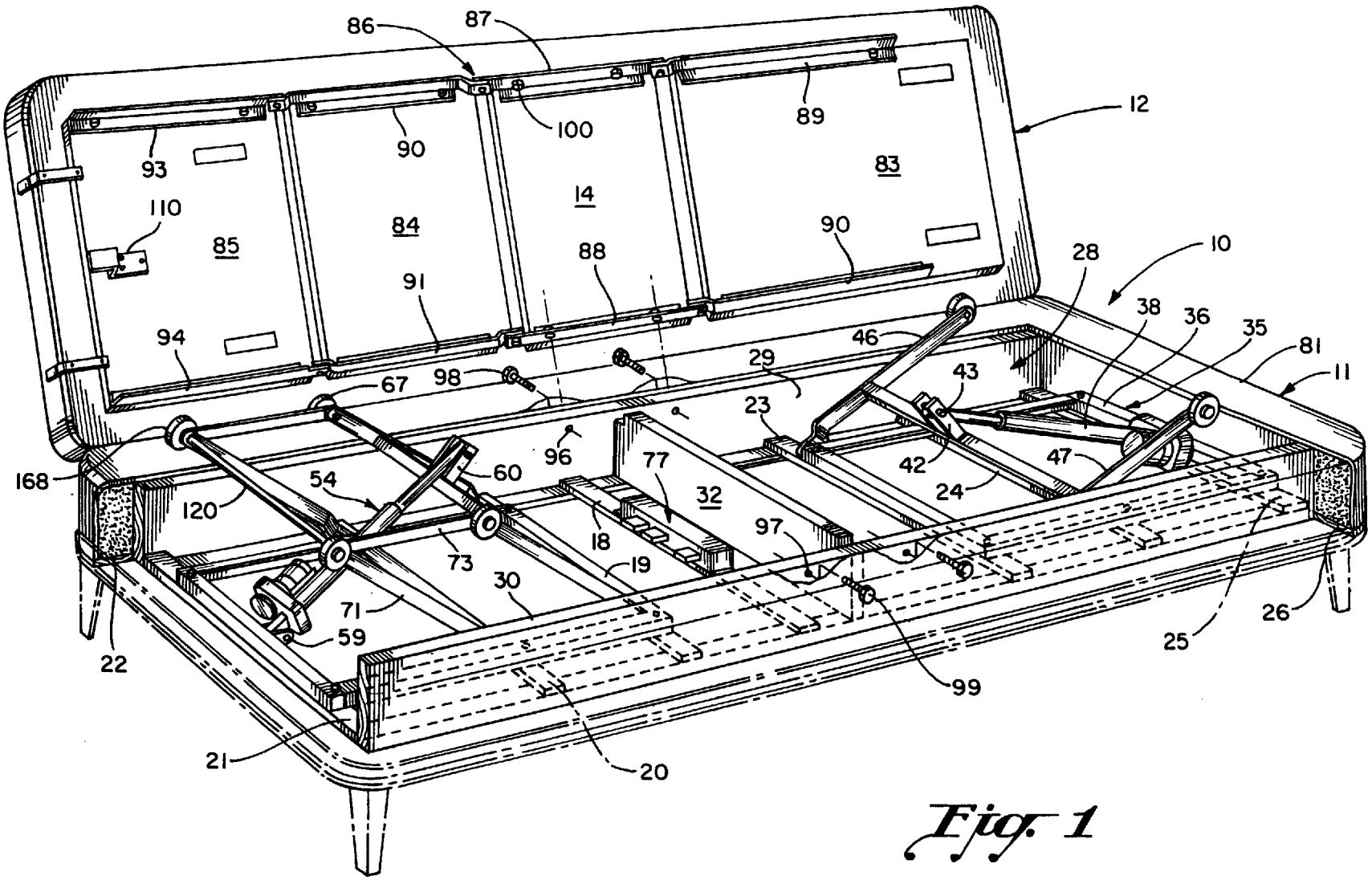
FIG. 1 is a perspective view of the present power integrated articulated inner spring-mattress with its upper section removed and pivoted away from the lower section.
Figure 2:
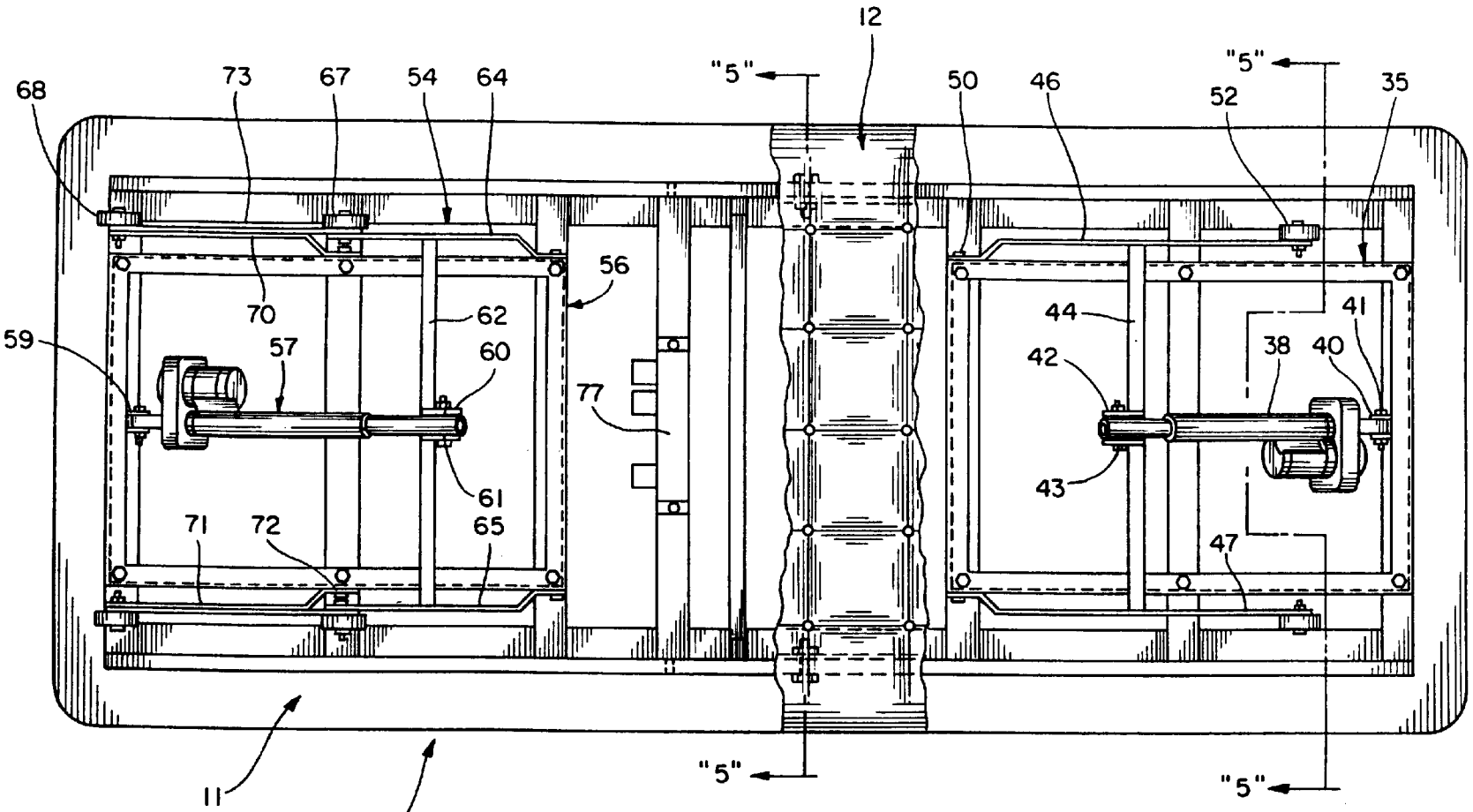
FIG. 2 is a top view of the lower section of the power integrated articulated inner spring-mattress illustrated in FIG. 1 with the upper section shown fragmented approximately centrally thereof.
Figure 5:
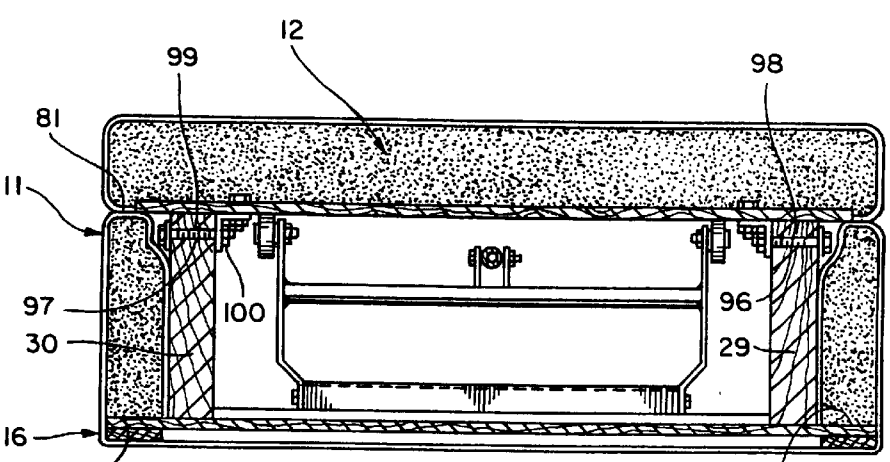
FIG. 5 is a cross-section taken generally along line 5—5 of FIG. 2.
Figure 4:
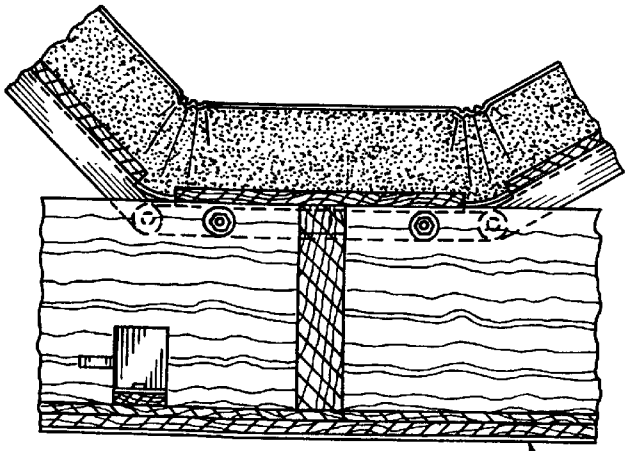
FIG. 4 is a fragmented longitudinal section showing the attachment of the upper section central portion to the lower section.
Figure 6:
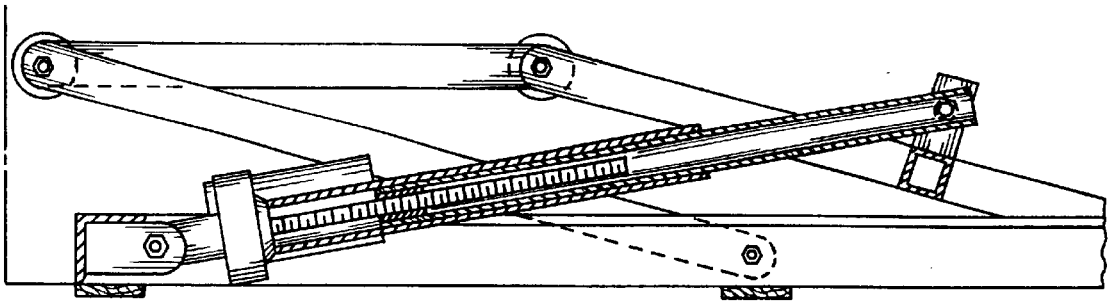
FIG. 6 is a sub-assembly view of the linear actuator for the mattress foot section and its associated parallelogram articulation linkage for the foot section.

The lower section 11 as seen best in FIGS. 1, 4 and 5, has a lower base 16 constructed of crossed 1"×3" wooden strips and more particularly a pair of longitudinally extending side strips 17 interconnected by a plurality of cross strips 18, 19, 20, 21, 22, 23, 24, 25 and 26. Note that all of these cross strips extend completely across the width of the lower section as seen by strip 18 in FIG. 5, and that they are indicated in part somewhat shorter in FIG. 1 simply for clarity.

Mounted on top of the base 16 is an "H" frame 28 that houses the operating mechanism for the upper section 12 and it also serves to support the upper section. The "H" frame 20 is constructed of wooden 2×4 side stringers 29 and 30 interconnected by a centrally mounted cross 2×4 cross members 32.

A head section power module 35 is mounted within frame 28 and includes a rectangular metal angle iron base frame 36 mounted on base cross strips 23 and 25, a linear actuator 38 releasably mounted to a frame welded bracket at 40 by fastener 41 at one end and releasably mounted to a cross member bracket 42 at the other end by fastener 43. Cross member 44 connects actuation arms 46 and 47 both pivoted at their ends at 50 to the head section power module frame 36. The actuation arms 46 and 47 have distal rollers 52 that engage and drive the head portion of the upper section 12 in articulation.

The lower section also includes a thigh and foot section power module 54 that is similar to the head section power module 35 and it includes a removable rectangular metal frame 56 and an identical linear drive actuator 57. Drive actuator 57 is pivotally connected to a frame welded bracket 59 at one end and pivotally removably mounted to a cross member welded bracket 60 at its other end by fastener 61. Foot section cross member 62 interconnects articulation arms 64 and 65 that carry mattress platform engaging rollers 67 at their distal ends.

The thigh and foot section module 54 also includes a second pair of articulated actuation arms 70 and 71 pivoted on frame 56 each having links 73 that connect to the ends of the thigh section articulation arms 64, 65 so that the arms 64 and 65, arms 70 and 71, and links 73 are driven as a parallelogram as seen in FIG. 1 as the thigh and foot section is raised and lowered.

It can be readily seen from this construction that the head section power module 35 and the foot section power module 54 can be manufactured as separate units and shipped along with control unit 77 to the mattress manufacturer for simple installation into a completely wooden lower section frame thereby eliminating the need for the manufacturer to have electro-mechanical or welding skills.

Furthermore, an important aspect of the present invention is that the linear actuators 38 and 57 are substantially perpendicular to their associated driven actuation arms in the uppermost position of the articulated mattress. That is, in the uppermost position of the articulated mattress illustrated in FIG. 3, actuator 38 is substantially perpendicular to actuation arm 47, and actuator 57 is substantially perpendicular to actuation arm 65. This provides improved support for the articulated mattress in its fully raised position.

Note that the "H" shaped frame 28 illustrated best in FIGS. 1, 2, 4 and 5, is considerably smaller than the lower section base 16 and at the perimeter of the "H" shaped frame 28 is encircled with an upholstered foam strip 80 having a flat top wall 81 that is coplanar with the top of the "H" frame 28. The purpose of the strip 80 is three-fold. It gives the lower section the appearance and feel of being an inner spring-mattress. And, because of the resiliency of the strip 80, human appendages caught between the upper section 12 and the lower section 11 as the upper section is lowered, are far less likely to be injured.

The upper section 12 includes a wooden mattress platform including a stationary wooden central platform portion 14, a head platform portion 83, a thigh platform portion 84, and a foot platform portion 85, articulated together by a mattress frame 86 constructed of metal. Frame 86 includes central frame members 87 and 88, head frame members 89 and 90 pivotally connected to central frame members 87 and 88, thigh section frame members 90 and 91 pivotally connected at one end to frame members 87 and 88, and at their other ends to foot section frame members 93 and 94.

The entire upper section 12 is connected to the lower section 11 by fastening the central frame members 87 and 88 to the "H" frame side stringers 29 and 30. Toward this end, the lower frame stringers 29 and 30 have pairs of holes 96 and 97 therethrough that receive fasteners 98 and 99. Aligned apertures are provided in frame members 87 and 88 along with aligned nuts 100 welded to the inner side of frame members 87 and 88. Note that the frame members 87 and 88 fit within the 2×4 frame side stringers 29 and 30.

As seen in FIG. 5, when the assembler at the customer location attaches the upper section 12 to the lower section 11, he depresses the foam strip 80 adjacent apertures 96 and 97 and inserts the fasteners 98 and 99 with the aid of a rachet wrench through holes 96 and 97 respectively, and threads them into nuts 100 securely fastening frame members 87 and 88 to the 2×4 lower section frame 28. The foam strip 80 is then released and covers these fasteners from view.

Figure 7:
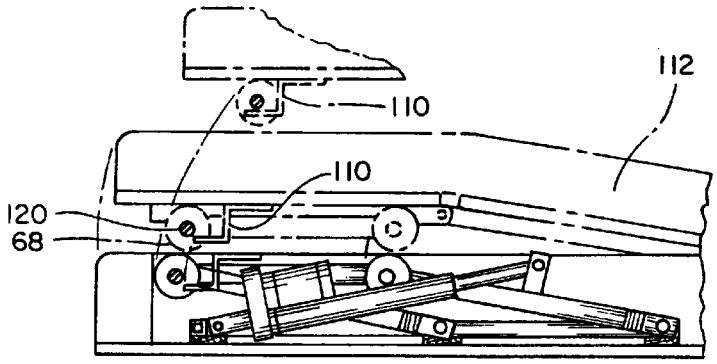
FIG. 7 is a fragmentary sequential view illustrating the release of the mattress foot section bracket from the rod interconnecting the foot section articulation arms as the mattress foot section is raised and lower from the lower section.

As seen more clearly in FIGS. 1 and 7, an "S" shaped bracket 110 is fastened to mattress platform portion 85 and is positioned to releasably engage rod 120. As seen in FIG. 7, the upper section 12 includes a heavy foam sheet 112 that is glued to the platform portions 14, 83, 84 and 85 and covered with a suitable upholstery material to define a mattress. The foam sheet 112 because of its inherent "memory" tends to straighten the platform portions 14, 83, 84 and 85 and raise the mattress foot section platform portion 85 away from the rollers 67 and 68 in the foot section power module.

As seen in FIG. 1, a rod 120 interconnects the distal ends of the foot section articulation arms 73, and this rod engages within bracket 110 as seen in FIGS. 3 and 7 as the mattress foot sections are raised and lowered. However, as the rollers 68 reach the position illustrated with a dotted lead line in FIG. 7, bracket 110 releases the rod 120 permitting the foot section to lower thereafter solely by gravity as opposed to being driven by cross rod 120. This action prevents any human appendage caught between the mattress foot portion and thigh portion and the lower section 11 from being clamped thereby eliminating human injury.

We claim:

1. A power integrated articulated inner spring-mattress for standard bed frames having upper and lower sections, comprising: a lower generally rectangular section having a substantially rigid lower base supportable on the side rails of a standard bed frame, said lower section having a rectangular supporting frame, said frame being smaller than and spaced inwardly from the base, resilient material surrounding the periphery of the frame on top of the lower base to provide an inner spring appearance to the lower section, at least one lower actuator mounted within the frame and connected to drive at least one articulation arm also pivotally mounted within the frame, and an articulated upper mattress section mounted on top of the lower section and being supportable on the upper surface of the frame, whereby the inner spring mattress has the appearance of a conventional inner spring-mattress but contains all the components for powered articulation.

2. A power integrated articulated inner spring-mattress as defined in claim 1, said upper section includes an articulated mattress frame having a first generally central portion fixed to the lower section frame, said mattress frame also having an articulated portion pivotally connected to the central portion, said upper section including a mattress platform having a first platform portion fixed to the frame central portion and a second articulated platform portion fixed to the frame articulated portion, a resilient covering extending over the mattress section.

3. A power integrated articulated inner spring-mattress as defined in claim 1, wherein the lower section base and frame are both constructed of wood to enable furniture manufacturers to assemble the inner spring-mattress.

4. A power integrated articulated inner spring-mattress as defined in claim 1, wherein the lower section base has a flat lower surface and neither of the rectangular frame nor linear actuator extends below the surface so the inner spring-mattress can be supported on a variety of standard bed frames with or without cross slats and even directly on the floor.

5. A power integrated articulated inner spring-mattress as defined in claim 1, wherein the lower section frame is constructed of a pair of spaced parallel two by fours interconnected approximately centrally by a cross two by four.

6. A power integrated articulated inner spring-mattress as defined in claim 1, wherein the central portion of the mattress frame is removably fastened to the lower section rectangular frame.

7. A power integrated articulated inner spring-mattress as defined in claim 1, wherein the central portion of the mattress frame is removably fastened to the lower section frame by a plurality of threaded fasteners that extend through apertures in the frame into threaded nuts carried by the central portion of the mattress frame, said resilient material surrounding the frame being deformable to accommodate the insertion of a tool between the upper and lower sections to connect the fasteners and position the upper section properly on the lower section during installation.

8. A power integrated articulated inner spring-mattress as defined in claim 1, wherein there are two linear actuators in the lower section frame each driving an articulation arm, said mattress frame and mattress platforms having at least two articulated portions pivotable by the two articulation arms.

9. A power integrated articulated inner spring-mattress for standard bed frames having upper and lower sections, comprising: a lower generally rectangular section having a substantially rigid lower base supportable on the side rails of a standard bed frame, said lower section having a rectangular supporting frame, said frame being smaller than and spaced inwardly from the base, resilient material surrounding the periphery of the frame on top of the lower base to provide an inner spring appearance to the lower section, at least one lower actuator mounted within the frame and connected to drive at least one articulation arm also pivotally mounted within the frame, and an articulated upper mattress section mounted on top of the lower section and being supportable on the upper surface of the frame, the lower section base and frame are both constructed of wood to enable furniture manufacturers to assemble the inner spring-mattress, whereby the inner spring mattress has the appearance of a conventional inner spring-mattress but contains all the components for powered articulation.

10. A power integrated articulated inner spring-mattress for standard bed frames having upper and lower sections, comprising: a lower generally rectangular section having a substantially rigid lower base supportable on the side rails of a standard bed frame, said lower section having a rectangular supporting frame, said frame being smaller than and spaced inwardly from the base, resilient material surrounding the periphery of the frame on top of the lower base to provide an inner spring appearance to the lower section, at least one lower actuator mounted within the frame and connected to drive at least one articulation arm also pivotally mounted within the frame, and an articulated upper mattress section mounted on top of the lower section and being supportable on the upper surface of the frame, the lower section base has a flat lower surface and neither of the frame nor linear actuator extends below the surface sot he inner spring-mattress can be supported on a variety of standard bed frames with or without cross slots and even directly on the floor, whereby the inner spring mattress has the appearance of a conventional inner spring-mattress but contains all the components for powered articulation.

11. A power integrated articulated inner spring-mattress for standard bed frames having upper and lower sections, comprising: a lower generally rectangular section having a substantially rigid lower base supportable on the side rails of a standard bed frame, said lower section having a rectangular supporting frame, said frame being smaller than and spaced inwardly from the base, resilient material surrounding the periphery of the frame on top of the lower base to provide an inner spring appearance to the lower section, at least one lower actuator mounted within the frame and connected to drive at least one articulation arm also pivotally mounted within the frame, and an articulated upper mattress section mounted on top of the lower section and being supportable on the upper surface of the frame, the lower section frame is constructed of a pair of spaced parallel two by fours interconnected approximately centrally by a cross two by four, whereby the inner spring mattress has the appearance of a conventional inner spring-mattress but contains all the components for powered articulation.

12. A power integrated articulated inner spring-mattress for standard bed frames having upper and lower sections, comprising: a lower generally rectangular section having a substantially rigid lower base supportable on the side rails of a standard bed frame, said lower section having a rectangular supporting frame mounted on the lower base, said frame being smaller than and spaced inwardly from the base, resilient material surrounding the periphery of the frame on top of the lower base to provide an inner spring appearance to the lower section, at least one lower actuator mounted within the frame and connected to drive at least one articulation arm also pivotally mounted within the frame, and an articulated upper mattress section mounted on top of the lower section and being supportable on the upper surface of the frame, the central portion of the mattress frame is removably fastened to the lower section frame by a plurality of threaded fasteners that extend through apertures in the frame into threaded nuts carried by the central portion of the mattress frame, said resilient material surrounding the frame being deformable to accommodate the insertion of a tool between the upper and lower sections to connect the fasteners and position the upper section properly on the lower section during installation, whereby the inner spring mattress has the appearance of a conventional inner spring-mattress but contains all the components for powered articulation.

13. A power integrated articulated inner spring-mattress as defined in claim 1, including means between the articulated mattress section and the lower section for releasing the driving engagement therebetween as the articulated mattress portion is lowered to prevent injury to appendages caught between the upper and lower sections.

14. A power integrated articulated inner spring-mattress as defined in claim 2, including means between the articulated mattress section and the lower section for releasing the driving engagement therebetween as the articulated mattress portion is lowered to prevent injury to appendages caught between the upper and lower sections, including a bracket mounted underneath the articulated mattress portion releasably engageable with the articulation arms as the upper mattress section is lowered against the lower section.

15. An articulated bed, comprising: a lower section having at least one linear actuator driving an articulation arm, an upper section mounted on top of the lower section having an articulated portion pivoted upwardly and downwardly by the articulation arm, means for connecting the articulated portion with the articulation arm during most of their movement, and means for releasing the engagement of the articulation arm from the articulated portion of the upper section just before the articulated portion is lowered to its lowermost position, said means for releasing the engagement of the articulation arm from the articulated portion being located at the articulated portion and releasing engagement every time the articulated portion is lowered.

16. An articulated bed, comprising: a lower section having at least one linear actuator driving an articulation arm, an upper section mounted on top of the lower section having an articulated portion pivoted upwardly and downwardly by the articulation arm, means for connecting the articulated portion with the articulation arm during most of their movement, and means for releasing the engagement of the articulation arm from the articulated portion of the upper section lust before the articulated portion is lowered to its lowermost position, and a resilient material mounted in upper section tending to straighten the upper section to a planar position, said means for maintaining the articulated portion connected with the articulated arm including an open bracket mounted on the underside of the articulated portion releasably engaging a cross rod carried by the articulation arm, said means for connecting the articulated portion and the articulation arm including spacing the pivotal axes of the articulation arm and the articulation portion so the bracket disengages the rod as the articulated portion nears the lower section to prevent injury.

17. An articulated bed, comprising: a lower section having at least one linear actuator driving an articulation arm, an upper section mounted on top of the lower section having an articulated portion pivoted upwardly and downwardly by the articulation arm, means for connecting the articulated portion with the articulation arm during most of their movement, and means for releasing the engagement of the articulation arm from the articulated portion of the upper section just before the articulated portion is lowered to its lowermost position, a resilient material mounted in the upper section tending to straighten the upper section to a planar position, said means for maintaining the articulated portion connected with the articulation arm including an open bracket mounted on the underside of the articulated portion releasably engaging a cross rod carried by the articulation arm, said means for connecting the articulated portion and the articulation arm including spacing the pivotal axes of the articulation arm and the articulation portion so the bracket disengages the rod as the articulated portion nears the lower section to prevent injury.

* * * * *